United States Patent [19]

Amano

[11] Patent Number: 4,649,873

[45] Date of Patent: Mar. 17, 1987

[54] OIL RETURN SYSTEM FOR OVERHEAD CAM ENGINE

[75] Inventor: Junkichi Amano, Iwata, Japan

[73] Assignee: Yamaha Hatsudoki Kabushiki Kaisha, Iwata, Japan

[21] Appl. No.: 767,367

[22] Filed: Aug. 20, 1985

[30] Foreign Application Priority Data

Nov. 1, 1984 [JP] Japan ..... 59-228943

[51] Int. Cl.[4] ..... F01M 11/04

[52] U.S. Cl. ..... 123/90.33; 123/193 H; 123/196 R

[58] Field of Search ..... 123/90.33, 90.38, 193 H, 123/196 R

[56] References Cited

U.S. PATENT DOCUMENTS

| | | | |
|---|---|---|---|
| 1,647,849 | 11/1927 | Woolson | 123/90.33 |
| 1,659,528 | 2/1928 | Hosterman | 123/90.33 |
| 2,758,580 | 8/1956 | Balzer | 123/90.33 |
| 2,996,050 | 8/1961 | Caris | 123/90.33 |
| 3,352,293 | 11/1967 | Hulten | 123/196 R |
| 4,359,018 | 11/1982 | Wade | 123/90.33 |
| 4,494,494 | 1/1985 | Yahiro et al. | 123/196 R |
| 4,584,975 | 4/1986 | Ohmi et al. | 123/90.38 |

*Primary Examiner*—Ira S. Lazarus

*Attorney, Agent, or Firm*—Ernest A. Beutler

[57] ABSTRACT

A lubricating system for an internal combustion engine including an improved lubricant return for returning lubricant from the valve actuating mechanism of the cylinder head to the crankcase.

8 Claims, 3 Drawing Figures

OIL RETURN SYSTEM FOR OVERHEAD CAM ENGINE

BACKGROUND OF THE INVENTION

This invention relates to an oil return system for an overhead cam engine and more particularly to an improved and highly effective system for returning oil from the valve operating mechanism to the crankcase.

The advantages of overhead valves for internal combustion engines are well known. The advantages of the overhead valve placement can be maximized by operating the valves directly from overhead mounted camshafts. Although such arrangements provide good performance, it is, of course, necessary to provide adequate lubrication for the valve actuating components. In additional to providing good lubrication for these components, it is also necessary to insure drainage of the lubricant back to the crankcase of the engine. The cylinder head in which the valves are positioned is, however, separated from the crankcase by the cylinder block and this presents certain difficulties with oil return. In addition, the valve mechanism is frequently located in an inclined manner both transversely and longitudinally. That is, with a V-type or inclined engine, one of the cam chambers may be inclined transversely to the horizontal. Also, it is the normal practice to mount an engine with its crankshaft somewhat offset from the horizontal and this also can present oil return problems in connection with the lubricating system of the valve actuators. Furthermore, when overhead camshafts are employed, it is the practice to support the camshaft for rotation at a number of places along its length so as to prevent flucture of the camshaft. The bearings themselves at as oil return dams thus further complicating the oil return arrangement.

It is, therefore, a principal object of this invention to provide an improved and simplified oil return arrangement an overhead valve internal combustion engine.

It is a still further object of this invention to provide an improved oil return system for the valve lubricating mechanism of an engine in which the valve actuating mechanism is inclined.

It is yet further object of this invention to provide an improved and simplified oil return system for an internal combustion engine and its valve actuating mechanism that will insure good drainage of the oil and return to the crankcase under all running conditions.

SUMMARY OF THE INVENTION

This invention is adapted to be embodied in an internal combustion engine having a cylinder block with a cylinder bore formed therein, a cylinder head affixed to the cylinder block, and exhaust passage means formed at one side of the cylinder head and terminating at the cylinder bore for discharge of exhaust gases therefrom. Exhaust valve means are supported in the cylinder head and valve actuating means is carried at least in part by the cylinder head for operating the exhaust valve means. Intake passage means are also formed at one side of the cylinder head and terminate at the cylinder bore for the introduction of an intake charge to the cylinder bore. Intake valve means and intake valve actuating means are supported by the cylinder head for controlling the flow through the intake passage means. A lubricant return extends longitudinally in the cylinder head beneath at least one of the passage means. An oil return conduit is formed in the cylinder head and extends between the area containing the valve actuating means and the lubricant return for delivering lubricant to the lubricant return. A drain conduit is formed in the cylinder head for returning lubricant to the engine crankcase from the lubricant return.

DETAILED DESCRIPTION OF THE PREFERRED EMBODIMENT

Figure 1:
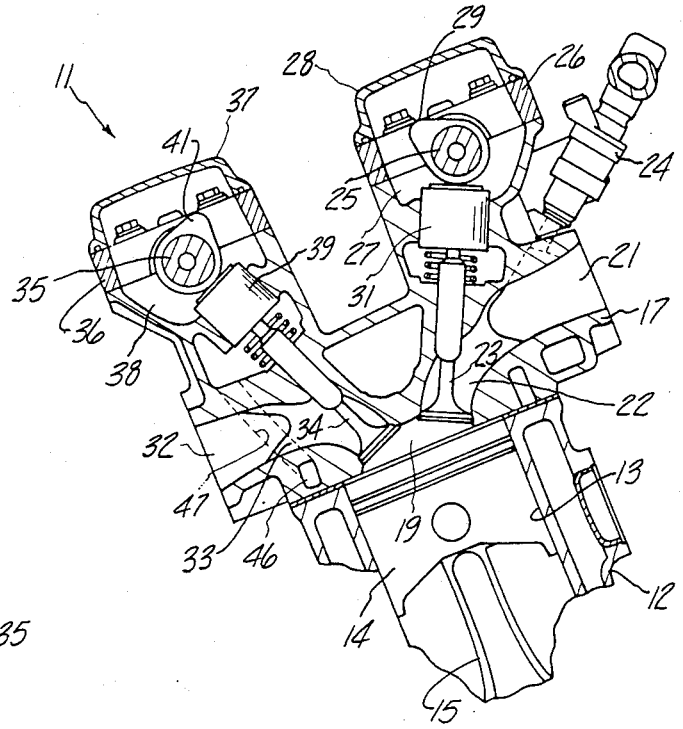
FIG. 1 is a cross-sectional view taken along the line 1—1 of FIG. 2 and shows an internal combustion engine constructed in accordance with an embodiment of the invention.

An internal combustion engine constructed in accordance with an embodiment of the invention is identified generally by the reference numeral 11. In the illustrated embodiment, the engine 11 is of the four cylinder inline type that is inclined to the vertical and which also has its output shaft axis inclined to the horizontal. Although the invention is disclosed in conjunction with such an embodiment, it is to be understood that the invention is susceptible of use with engines of other cylinder types and other cylinder formations. However, the invention has particularly utility with engines wherein the cylinder bores are inclined to the vertical and/or where the crankshaft is inclined to the horizontal. In addition to inline engines, V-type engines normally have such a configuration as do other types of engines as well known to those skilled in the art.

Figure 2:
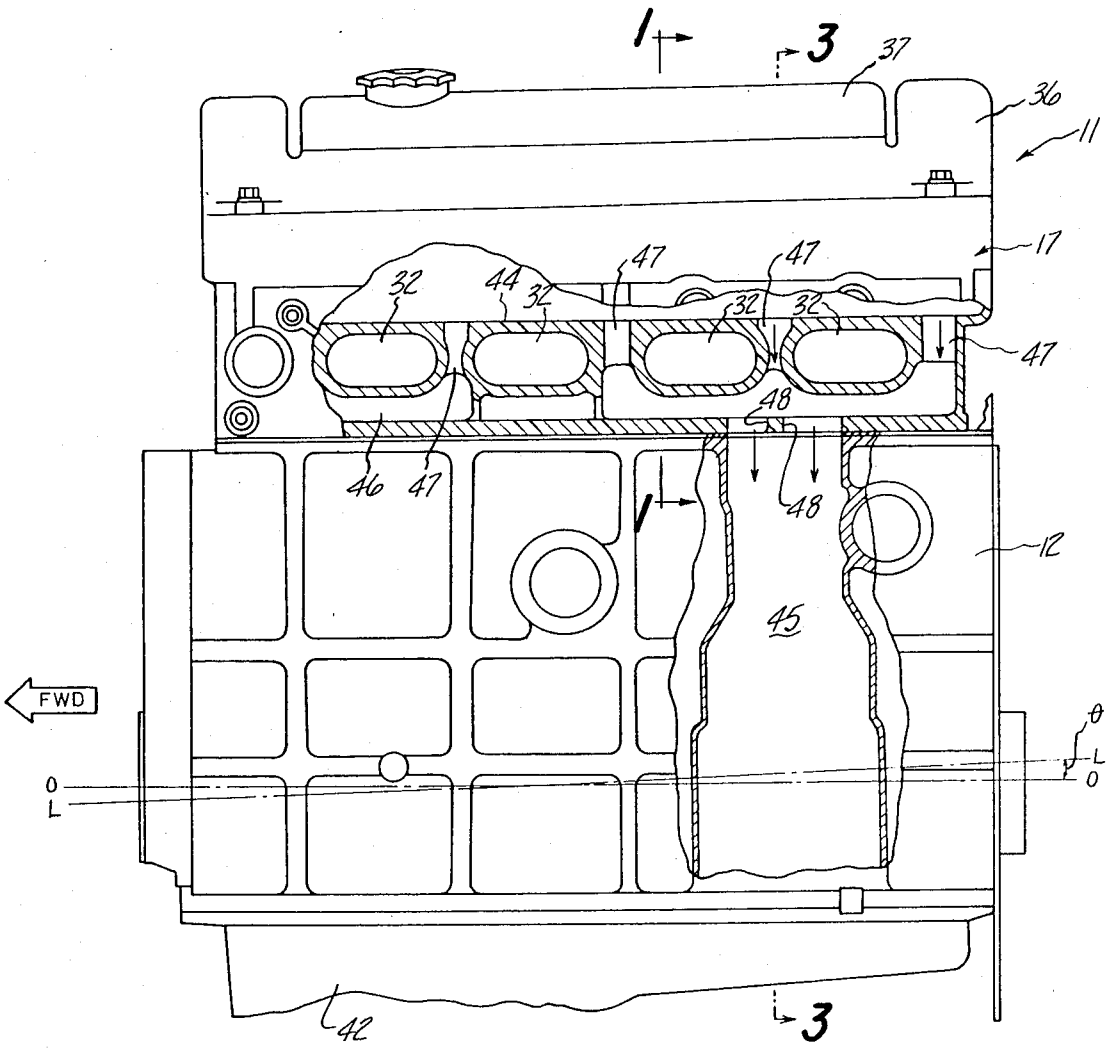
FIG. 2 is a side elevational view, with portions broken away, of the engine.

The engine 11 includes a cylinder block 12 that is formed with a plurality of cylinder bores 13 which are aligned due to the inline configuration of the engine 11. The cylinder bores 13 are disposed with their axes at an angle to the vertical such as is common with inclined engines or with the banks of a V-type engine. Pistons 14 are supported for reciprocation in the cylinder bores 13 and are connected by means of connecting rods 15 so as to drive a crankshaft 16. The crankshaft 16 has its rotational axis 0—0 disposed at an angle $\theta$ to the horizontal L—L so that the engine tilts rearwardly downwardly as clearly seen in FIG. 2 wherein the forward direction is indicated by the arrow FWD.

A cylinder head 17 is affixed to the cylinder block 12 in a known manner, as by means of holddown bolts 18. The cylinder head 17 is formed with individual recesses 19, each of which cooperates with a respective cylinder bore 13 and piston 14 to provide a chamber of variable volume which may be considered as the combustion chamber.

An induction system is provided for delivering an intake charge to the combustion chamber 19. This induction system includes a siamese-type intake port 21 for each cylinder bore 13 that divides into a pair of runners 22 that communicate with the combustion chamber 19. Intake valves 23 cooperate with valve seats formed at the ends of the runners 22 so as to control the flow of an intake charge into the chamber 19. That is, there are two intake valves 23 per chamber 19. A suitable air intake manifold (not shown) is provided for delivering a charge to the inlet ends of the intake passages 21. In additional, a fuel injection nozzle 24 is carried by the cylinder head 17 and cooperates with each induction passage 21 for spraying fuel into the intake air charge.

An intake camshaft 25 is rotatably journaled in the cylinder head 17 by means of a cam box 26 and which defines a valve actuating chamber 27 with the cylinder head 17 and a cam cover 28 that is affixed to the cam box 26 and cylinder head 17 in an appropriate manner. The intake cam 25 has individual cam lobes 29 each of which cooperate with thimble tappets 31 that are slidably supported in the cylinder head assembly 17 and cooperate with the intake valves 23 for actuating them in a known manner.

It should be noted that the intake valves 23 are all positioned on one side of the axis of the cylinder bore 13 and due to the inclined orientation of the engine, they are positioned at the upper portion of the engine as clearly seen in FIG. 1.

On the opposite side of the cylinder head 17, there are provided a plurality of siamesed exhaust passages 32 that extend into individual branch passages 33, two of which serve each combustion chamber 19. The passages 33 terminate in valve seats and exhaust valves 34 control the flow of exhaust gases from the chambers 19 into the passages 33 and 32 for discharge to the atmosphere through a suitable exhaust manifold and exhaust system (not shown). Like the intake valves 23, there are two exhaust valves 34 for each combustion chamber 19.

Like the intake valves 23, the exhaust valves 34 are operated by means of an overhead mounted exhaust camshaft 35. The camshaft 35 is mounted in the cylinder head assembly by means including a cam box 36 that is affixed in a suitable manner to the cylinder head 17. A cam cover 37 is, in turn, fixed to the cam box 36 and cylinder head 17 so as to define a valve actuating chamber 38.

Thimble tappet assemblies 39 are slidably supported in the cylinder head 17 and cooperate with respective cam lobes 41 on the exhaust camshaft 35 for operating the individual exhaust valves 34.

The intake camshaft 25 and exhaust camshaft 35 are driven in a suitable manner in timed relationship with the crankshaft 16, as by means of timing belts, chains or a gear drive. Since the manner in which the camshafts 25 and 35 are driven forms no portion of the invention, this mechanism will not be described any further.

Figure 3:
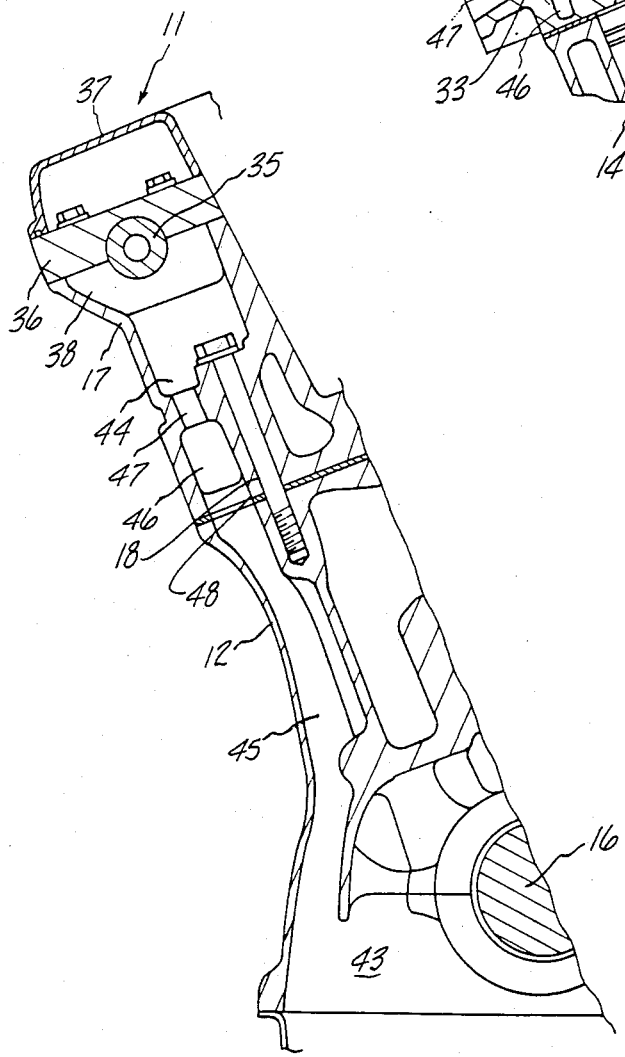
FIG. 3 is a cross-sectional view taken along the line 3—3 of FIG. 2.

The engine 11 is also provided with a lubricating system and for this purpose a crankcase 42 is affixed to the underside of the cylinder block and defines a crankcase chamber 43 (FIG. 3) in which lubricant is received and retained. This lubricant is circulated to the various components of the engine to be lubricated by means of a lubricating pump (not shown). This lubricating system includes an arrangement for lubricating the camshafts 25 and 35 and the individual lobes 29 and 41 and their point of contact with the thimble tappets 31 and 39. Since the arrangement for delivering lubricant to these surfaces to be lubricated forms no part of the invention, this also has not been illustrated in any detail nor will it be described. Those skilled in the art are well versed with manners in which this lubrication may become accomplished.

In additional to delivering lubricant to the camshafts 25 and 35 and the associated valve actuating components including the thimble tappets 31 and 39, it is necessary to return the excess lubricant back to the crankcase 41. This is a particular problem when the engine is inclined both from the vertical and from the horizontal as with the engine 11. The return problem is rendered more difficult in view of the fact that the bearing arrangement for rotatably journaling the camshafts normally divides the chambers 27 and 38 into a number of longitudinally spaced discrete areas. That is, the camshafts 25 and 35 are each supported at spaced locations along their length by bearings that are formed in part by the cylinder head 17 and the upstanding walls that form these bearing surfaces divide the chambers 27 and 38 and specifically the chamber 38 into a number of discrete areas. A lower wall 44 of the cylinder head 17 defines the bottom of the exhaust valve actuating mechanism chamber 38 and, as noted, this area may be divided into a number of spaced chambers by the aforedescribed bearing walls. In order to simplify the oil return arrangement, a single oil drain conduit 45 is provided in the cylinder block assembly 12 at the rear end of the block assembly so that the passage 45 will receive oil delivered from the valve actuating mechanism and specifically from the chamber 38 by gravity through the return system now to be described.

An oil return conduit 46 extends through the cylinder head assembly 17 in an area beneath the area where the exhaust gas passages 32 and 33 extend. The return conduit 45 receives oil from the individual compartments of the exhaust valve actuating chamber 38 by means of individual generally vertically extending return conduits 47. There is at least one such conduit 47 for each of the respective chambers of the sections of the exhaust valve actuating chamber 38. Preferably, these return conduits 47 are formed at the lowest portion of each section. These conduits 47 all communicate with the lubricant return 46 so that oil may flow by gravity into the return 46.

A pair of drain openings 48 extend from the lower portion of the cylinder head 17 and specifically through its lower face so as to communicate with the cylinder block oil drain conduit 45. In this way, lubricant may flow freely back into the crankcase chamber 43.

It should be readily apparent from the foregoing description that a highly effective yet relatively simple lubricant return system is provided for returning lubricant from the valve actuating mechanism back to the crankcase 42 even though the engine is disposed at an angle both to the vertical and to the horizontal. Although an embodiment of the invention has been illustrated and described, various changes and modifications may be made without departing from the spirit and scope of the invention, as defined by the appended claims.

What is claimed is:

1. An internal combustion engine having a cylinder block with a cylinder bore formed therein and extending at an inclined angle to the vertical, a cylinder head affixed to said cylinder block and inclined to the horizontal to form a lower side at one side thereof and a higher side at the other side thereof, exhaust passage means formed at one side of said cylinder head and terminating at said cylinder bore for discharge of exhaust gases, exhaust valve means supported by said cylinder head for controlling the flow through said exhaust passage means, exhaust valve actuating means carried at least in part by said cylinder head for operating said exhaust valves, intake passage means formed at one side of said cylinder head and terminating at said cylinder bore for the induction of an intake charge into said cylinder bore, intake valve means supported by said cylinder head for controlling the flow through said intake passage means, intake valve actuating means carried at least in part by said cylinder head for actuating said intake valves, a lubricant return extending longitudinally in said cylinder head beneath one of said passage means and at the lower side of said cylinder head, a return conduit formed in said cylinder head at its lower side and extending between the area containing said valve actuating means and said lubricant return for delivering lubricant to said lubricant return and a drain conduit formed in said engine below said return conduit for returning lubricant to the engine crankcase from said lubricant return.

2. An internal combustion engine as set forth in claim 1 wherein there are a plurality of cylinder bores and exhaust and intake passage means each serving the respective cylinder bores and the lubricant return extends beneath all of the same type of passage means.

3. An internal combustion engine as set forth in claim 2 wherein the cylinder head is formed with a valve actuating mechanism containing chamber that is divided into separate sections and there is a return conduit extending from each of the sections to the lubricant return.

4. A internal combustion engine as set forth in claim 3 wherein there is a single drain conduit formed at one end of the lubricant return.

5. A "V" type internal combustion engine having a cylinder block with a pair of cylinder banks, each cylinder bank having a cylinder bore formed therein, a pair of cylinder heads affixed to a respective cylinder bank, exhaust passage means formed at one side of each of said cylinder heads and terminating at a respective cylinder bore for discharge of exhaust gases, exhaust valve means supported by each said cylinder head for controlling the flow through said exhaust passage means, exhaust valve actuating means carried at least in part by each said cylinder head for operating said exhaust valves, intake passage means formed at one side of each said cylinder heads and terminating at a respective cylinder bore for the induction of an intake charge into said respective cylinder bore, intake valve means supported by each said cylinder head for controlling the flow through said intake passage means, intake valve acutating means carried at least in part by each said cylinder head for actuating said intake valves, a lubricant return extending longitudinally in the lower side of each said cylinder head beneath one of said passage means, a return conduit formed in the lower side of each said cylinder head and extending between the area containing said valve actuating means and said lubricant return for delivering lubricant to said lubricant return and a pair of drain conduits formed in the outer walls of each of said cylinder banks of said engine for returning lubricant to the engine crankcase from said lubricant return.

6. An internal combustion engine as set forth in claim 5, wherein there are a plurality of cylinder bores in each cylinder bank and exhaust and intake passage means of each cylinder head each serving the respective cylinder bores and the lubricant return extends beneath all of the same type of passage means.

7. An internal combustion engine as set forth in claim 6 wherein each cylinder head is formed with a valve actuating mechanism containing chamber that is divided into separate sections and there is a return conduit extending from each of the sections to the respective lubricant return.

8. An internal combustion engine as set forth in claim 7 wherein there is a single drain conduit for each cylinder block formed at one end of the lubricant return.

* * * * *